US011767201B2

(12) United States Patent
Marshall, III et al.

(10) Patent No.: US 11,767,201 B2
(45) Date of Patent: Sep. 26, 2023

(54) CRAWL SPACE WINCH SYSTEM

(71) Applicant: Your Crawl Space, Inc., McClellanville, SC (US)

(72) Inventors: Henry Bennie Marshall, III, Pawleys Island, SC (US); Mitchel Sutherland, Muncie, IN (US)

(73) Assignee: Your Crawl Space, Inc., McClellanville, SC (US)

( * ) Notice: Subject to any disclaimer, the term of this patent is extended or adjusted under 35 U.S.C. 154(b) by 0 days.

(21) Appl. No.: 17/743,967

(22) Filed: May 13, 2022

(65) Prior Publication Data

US 2022/0363523 A1 Nov. 17, 2022

Related U.S. Application Data

(60) Provisional application No. 63/189,323, filed on May 17, 2021.

(51) Int. Cl.
*B66D 3/00* (2006.01)

(52) U.S. Cl.
CPC ..... *B66D 3/006* (2013.01); *B66D 2700/0141* (2013.01); *B66D 2700/0183* (2013.01); *B66D 2700/021* (2013.01)

(58) Field of Classification Search
CPC .. B65H 2403/70; B65H 2403/72; B66D 1/00; B66D 1/04; B66D 1/28; B66D 1/42; B66D 1/66; B66D 3/00; B66D 3/02; B66D 3/006; B66D 3/20; B66D 3/26; B66D 2700/0141; B66D 2700/0183; B66D 2700/021; B66D 2700/0125; B66D 2700/025
USPC ..... 254/362
See application file for complete search history.

(56) References Cited

U.S. PATENT DOCUMENTS 3,051,447 A * 8/1962 Ahlbin ..... B66D 3/02 254/362
3,467,359 A * 9/1969 Durand ..... B66D 3/00 254/343
3,544,054 A * 12/1970 Ward ..... A47L 13/62 182/230
4,045,001 A * 8/1977 Harvey, Jr. ..... B66D 1/36 242/157.1
5,374,035 A * 12/1994 Santos ..... F16D 49/00 254/323

(Continued)

FOREIGN PATENT DOCUMENTS

CN 110626973 A 12/2019
DE 102019120166 A1 1/2021
WO WO-2008060593 A2 * 5/2008 ..... B66D 3/20

*Primary Examiner* — Michael R Mansen
*Assistant Examiner* — Henrix Soto
(74) *Attorney, Agent, or Firm* — Kim and Lahey Law Firm, LLC; Seann P. Lahey

(57) ABSTRACT

A crawl space winch system including a base plate; a winch box carried by said base plate; a winch mechanism disposed in said winch box and having a cable extending out of an opening in a front side of said winch box for attaching to an item; a winch drive shaft extending through a sidewall of said winch box and being operatively associated with said winch mechanism for retracting said cable; and, a primary anchor opening disposed in a generally central portion of said base plate for receiving a portion of a primary anchor to secure said base plate to the ground, and wherein said primary anchor provides a pivot point around which said base plate rotates.

16 Claims, 7 Drawing Sheets

(56) References Cited

U.S. PATENT DOCUMENTS

| | | | | |
|---|---|---|---|---|
| 6,241,215 | B1 | 6/2001 | Gersemsky et al. | |
| 6,595,495 | B1 * | 7/2003 | Hung | B66D 1/38 254/326 |
| 7,913,978 | B1 | 3/2011 | Trihey et al. | |
| 2008/0048162 | A1 * | 2/2008 | Grapes | B66D 1/04 254/323 |
| 2008/0061277 | A1 * | 3/2008 | Grapes | B66D 1/36 254/352 |
| 2012/0318597 | A1 | 12/2012 | Yoder | |
| 2013/0056694 | A1 * | 3/2013 | Wilkins | B66D 5/00 475/318 |
| 2014/0084229 | A1 * | 3/2014 | Morrison | B66D 3/006 254/344 |
| 2019/0290510 | A1 | 9/2019 | Cardona et al. | |
| 2020/0148514 | A1 * | 5/2020 | Grayson | B66D 3/20 |
| 2021/0138855 | A1 * | 5/2021 | Fukayo | E02F 3/96 |

* cited by examiner

CRAWL SPACE WINCH SYSTEM

BACKGROUND OF THE INVENTION

1) Field of the Invention

The present invention relates to a winch system, and more particularly, to a winch system to be use in tight confined spaces such as a building crawl space.

2) Description of Related Art

Crawl spaces and basements can often be difficult to work in, sometimes offering less than two feet of clearance. Typically, materials being used in crawl spaces and basements will be sand, dirt, stone, mechanical equipment, bricks, concrete blocks, concrete mix, water heaters, HVAC equipment, etc. These areas have very few options to get these heavy materials to the work areas, and the confined spaces make the task even more difficult. Usually, the materials are simply moved by hand, which takes extra time and effort to accomplish the work. In some case, the materials can be dragged by hand in small carts to the work area. As such, considerable time and effort is spent just getting the materials to the work area in the crawl space or basement.

Accordingly, it is an object of the present invention to provide a winch system for use in confined areas like crawl spaces and basement to assist in transporting materials to a work area.

It is a further object of the present invention to provide a portable winch system that can be easily installed in a confined space and able to pull heavy loads of material to a work area.

SUMMARY OF THE INVENTION

The above objectives are accomplished according to the present invention by providing a crawl space winch system comprising a base plate; a winch box carried by said base plate; a winch mechanism disposed in said winch box and having a cable extending out of an opening in a front side of said winch box for attaching to an item; a winch drive shaft extending through a sidewall of said winch box and being operatively associated with said winch mechanism for retracting said cable; and, a primary anchor opening disposed in a generally central portion of said base plate for receiving a portion of a primary anchor to secure said base plate to the ground, and wherein said primary anchor provides a pivot point around which said base plate rotates.

In a further advantageous embodiment, the base plate includes upturned edge portions extending along a perimeter on each side that facilitate sliding of the base plate on the ground and resist digging into the ground.

In a further advantageous embodiment, said winch drive shaft is adapted to engage a portable electric hand tool for rotating said drive shaft.

In a further advantageous embodiment, a support bracket is mounted on said base plate adjacent said winch box and laterally spaced from said winch drive shaft for receiving said portable electric hand tool.

In a further advantageous embodiment, at least one storage slot is disposed in said winch box for carrying accessory items.

In a further advantageous embodiment, a lid is pivotally carried on a top side of said winch box for enclosing said winch box.

In a further advantageous embodiment, a shield is pivotally carried by said lid and operable between a deployed position extending upwardly from said lid, and a retracted position laying horizontally on top of said lid.

In a further advantageous embodiment, a knee pad is disposed on a top side of said base plate.

In a further advantageous embodiment, at least one drain hole opening is dispose in said winch box.

In a further advantageous embodiment, a handle opening is disposed in said base plate to assist in carrying and moving said base plate.

In a further advantageous embodiment, a series of secondary anchor openings are disposed adjacent a perimeter edge of said base plate for receiving a secondary anchor to secure said base plate to the ground.

In a further advantageous embodiment, said secondary anchor comprises a stake.

In a further advantageous embodiment, a second primary anchor opening is disposed along a rear perimeter edge of said base plate.

In a further advantageous embodiment, said primary anchor openings each define a different shaped keyway for receiving a portion of a primary anchor.

In a further advantageous embodiment, said primary anchor comprise a screw anchor.

In a further advantageous embodiment, said primary anchor opening is aligned in a linear arrangement with said winch mechanism in said winch box.

In a further advantageous embodiment, said base plate includes a recessed portion along one side of said base plate in which a width of said base plate is narrowed such that a front perimeter edge is longer than a rear perimeter edge.

BRIEF DESCRIPTION OF THE DRAWINGS

The system designed to carry out the invention will hereinafter be described, together with other features thereof. The invention will be more readily understood from a reading of the following specification and by reference to the accompanying drawings forming a part thereof, wherein an example of the invention is shown and wherein.

Figure 1:
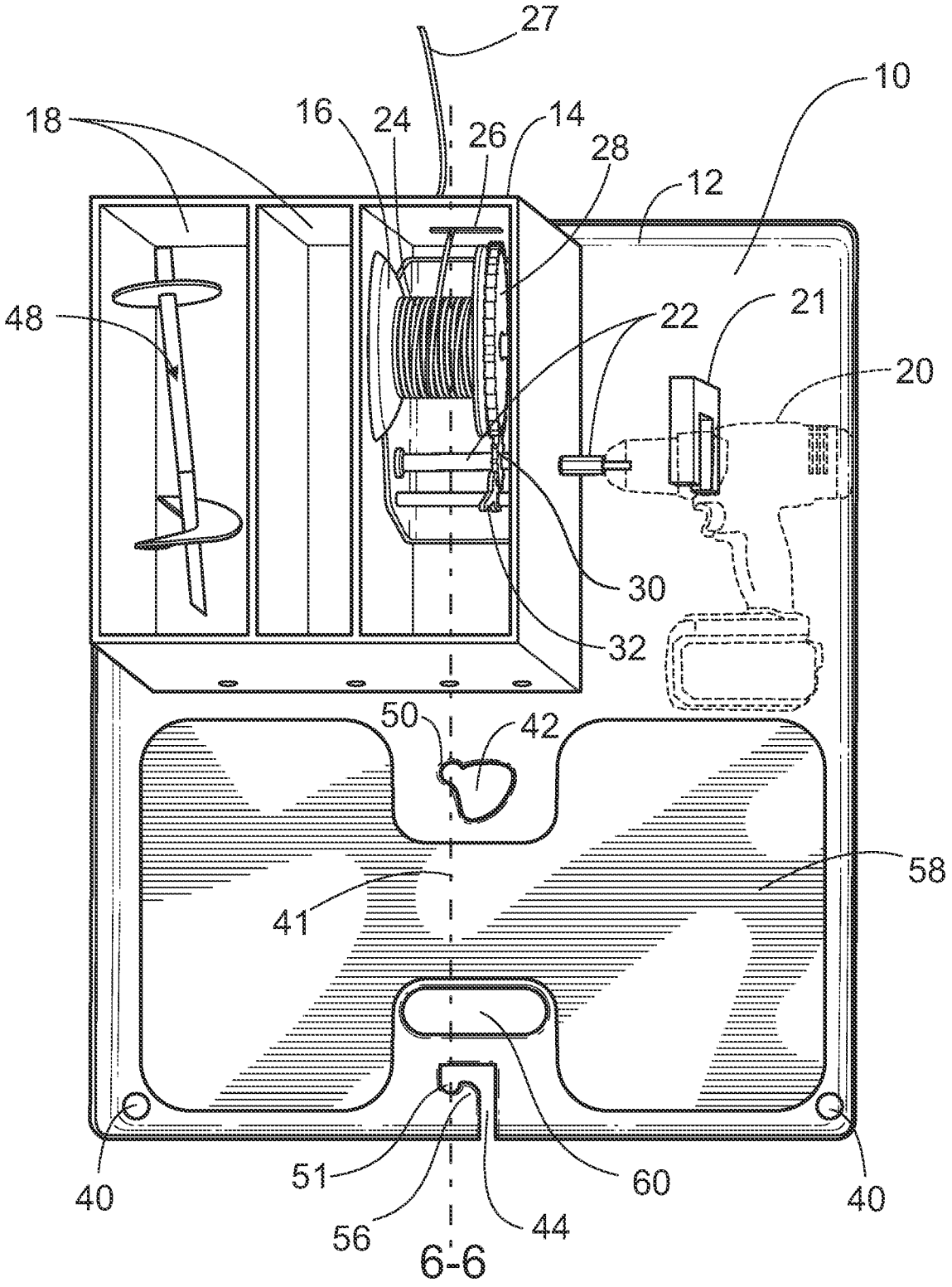
FIG. 1 shows a top perspective view of the crawl space winch system according to the present invention.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The present invention helps with moving heavy loads in tight, confined areas such as in crawl spaces and basements, which can sometimes have less than two feet of clearance. This invention is used to tow a sled or the like with a heavy load through the confined space. The crawl space winch system of the present invention can be easily installed in a confined space and is capable of pulling several thousand pounds of material when anchored to the ground.

Figure 5:
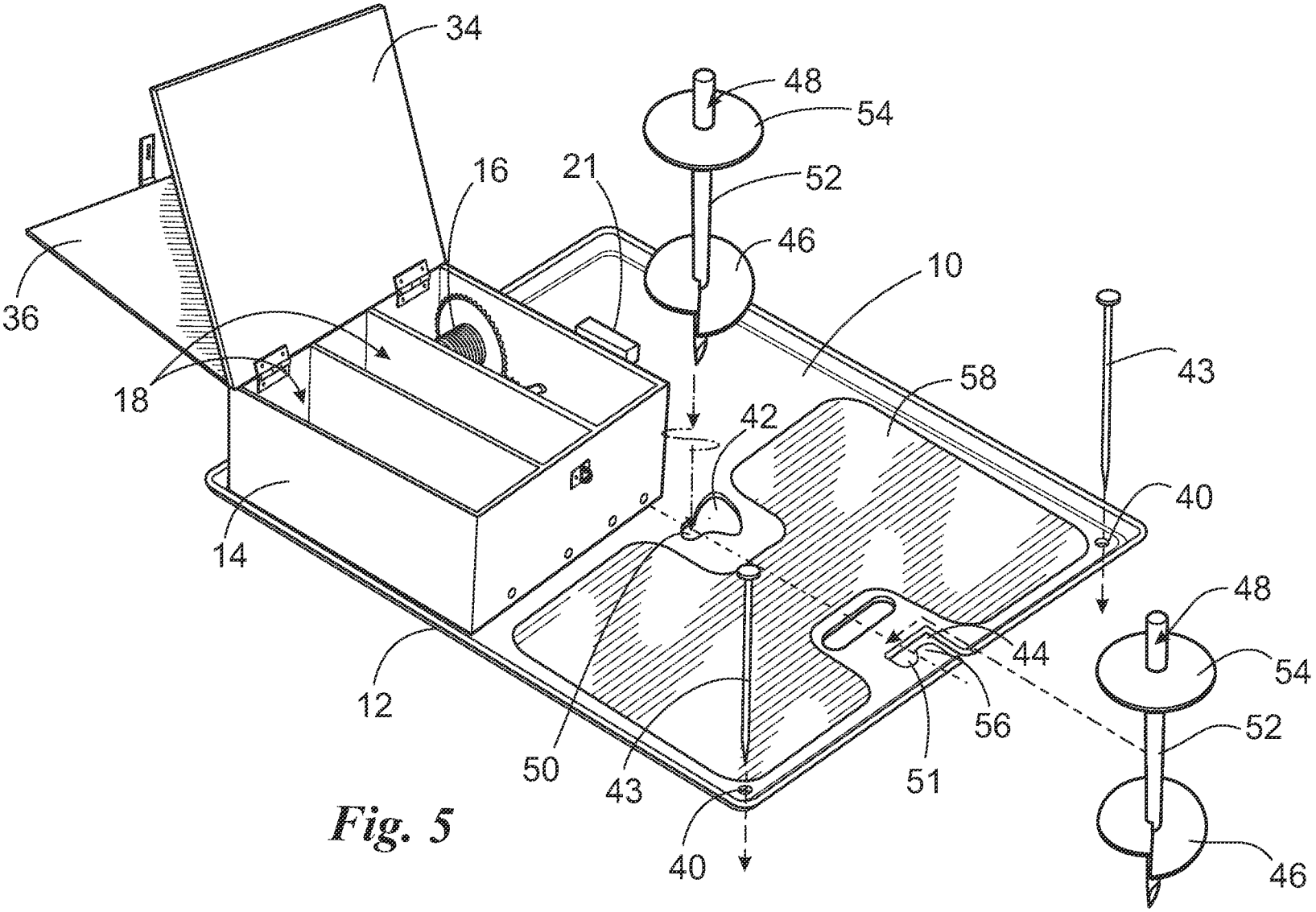
FIG. 5 shows a top perspective view of the crawl space winch system with primary and secondary anchors aligned with primary and secondary anchor openings according to the present invention.
Figure 10:
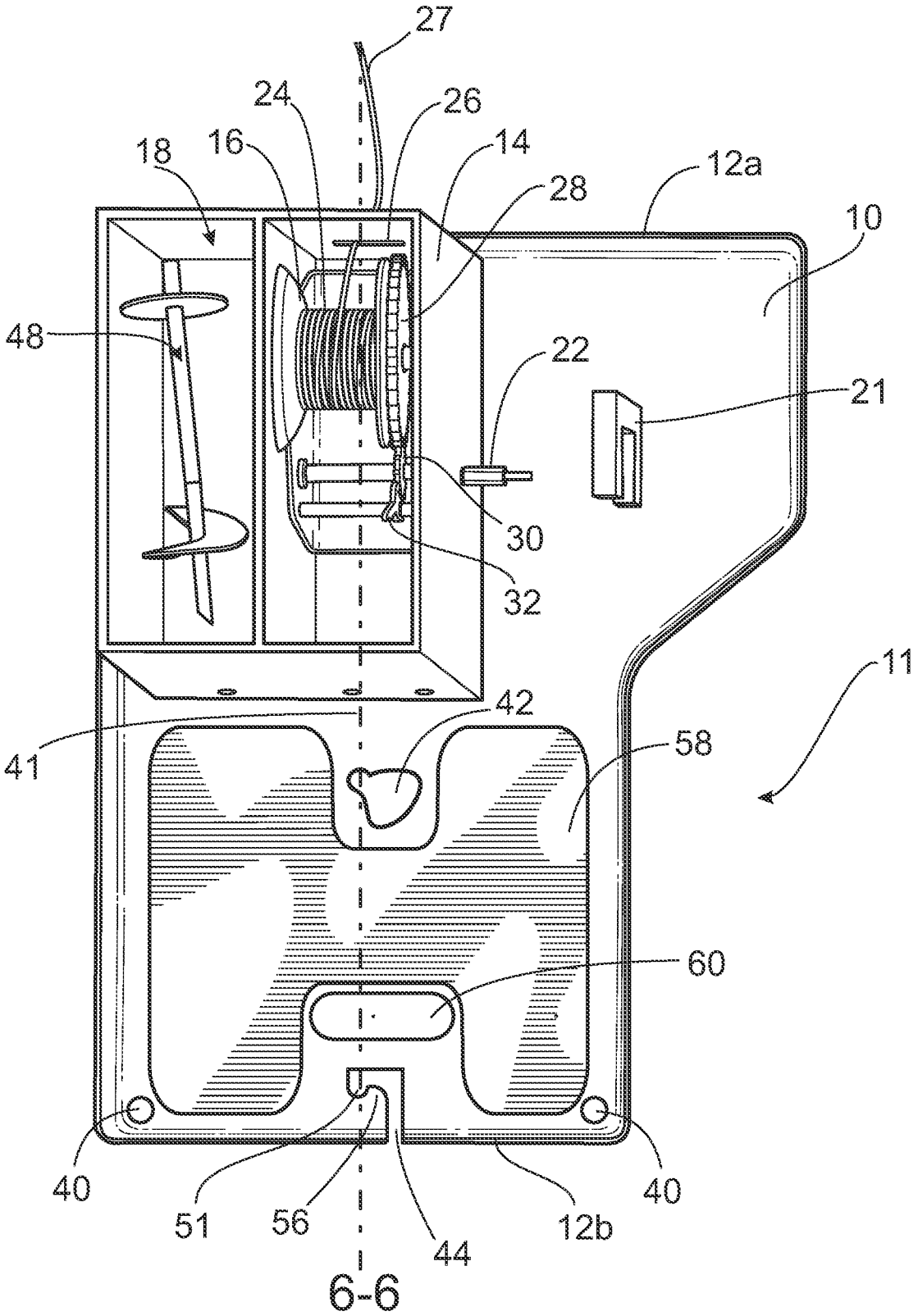

Referring to FIGS. 1, 5 and 10, the crawl space winch system of the present invention comprises a base plate 10. In preferred embodiments, base plate 10 will be around about 24 inches wide to around about 30 inches long. However, the size dimensions will vary depending on areas of use and intended load to be pulled. As shown in the illustrated embodiments, base plate 10 includes rounded upturned edges 12 around the perimeter of base plate 10 to facilitate sliding and resist digging into the ground. Base plate 10 is illustrated in a generally rectangular format, but may be other shapes, such as circular, and is not limited to just the illustrated disclosure. As shown in the embodiment of FIG. 10, base plate 10 includes a recessed portion, designated generally as 11, along one side in which a width of base plate 10 is narrowed such that a front perimeter edge 12*a* is longer than a rear perimeter edge 12*b*. This allows the shorter end to be inserted into an opening first and then the base plate rotated to fit the larger side through the opening to facilitate ingress and egress from a crawl space.

Referring to FIGS. 1, 3, 5, 6, 7 and 10, a winch box 14 is mounted toward a front end of base plate 10. Winch box 14 contains a winch mechanism 16 and a storage slot or slots 18 for tools and anchors for securing base plate 10 to the ground. In the illustrated embodiment, the winch mechanism 16 is contained in one section of the winch box 14 apart from the storage slots 18. In one embodiment, the winch mechanism 16 is a basic manual, hand or screw winch that is preferably driven by a portable electric hand tool 20, such as a drill or other battery powered device capable of rotating a winch drive shaft 22.

Referring to FIGS. 1, 3, 6, 7 and 10 in the illustrated embodiments, the winch mechanism 16 includes a spool 24 for carrying a strap/rope/cable 27. The cable extends out of the winch box through a cable opening 26 for attaching the cable to an item for winching. The cable will typically attach to a sled to pull material to a work area. This system is intended to tow a sled, bin, or like hauling device that preferably has a low profile, usually around eight inches high.

Referring to FIGS. 1, 3, 6, 7 and 10 in the illustrated embodiments, winch mechanism 16 further includes a large spool gear 28 attached to the spool 24. A smaller drive gear 30 is attached to the winch drive shaft 22 and engages the large spool gear 28 inside the winch box 14 to turn the spool 24 to retract the cable. As best shown in FIG. 1, winch drive shaft 22 extending through a sidewall of winch box 16 and is thus operatively associated with the winch mechanism 16 for retracting the cable when rotated by the portable electric hand tool 20, other electric motor, or even a manual hand crank, to turn the winch mechanism 16. In the illustrated embodiment, a pivotally mounted catch pawl 32 is included adjacent the small drive gear 30 to prevent unwanted reverse movement of the spool gear 28 that could cause the cable to extend off the spool 24. The catch pawl engage the gear teeth of the drive gear 30 when extending the cable out to prevent rotation unless it is manually depressed to prevent engagement and allow the spool to release and extend out the cable. Preferably, a support bracket 21 is mounted on base plate 10 adjacent winch box 14 and laterally spaced from winch drive shaft 22 for receiving the portable electric hand tool 20. In the illustrated embodiment, support bracket 21 is a generally C-shaped bracket that received a portion of the housing for the portable electric hand tool 20 to help hold the tool in place when operating winch mechanism 16.

Figure 6:
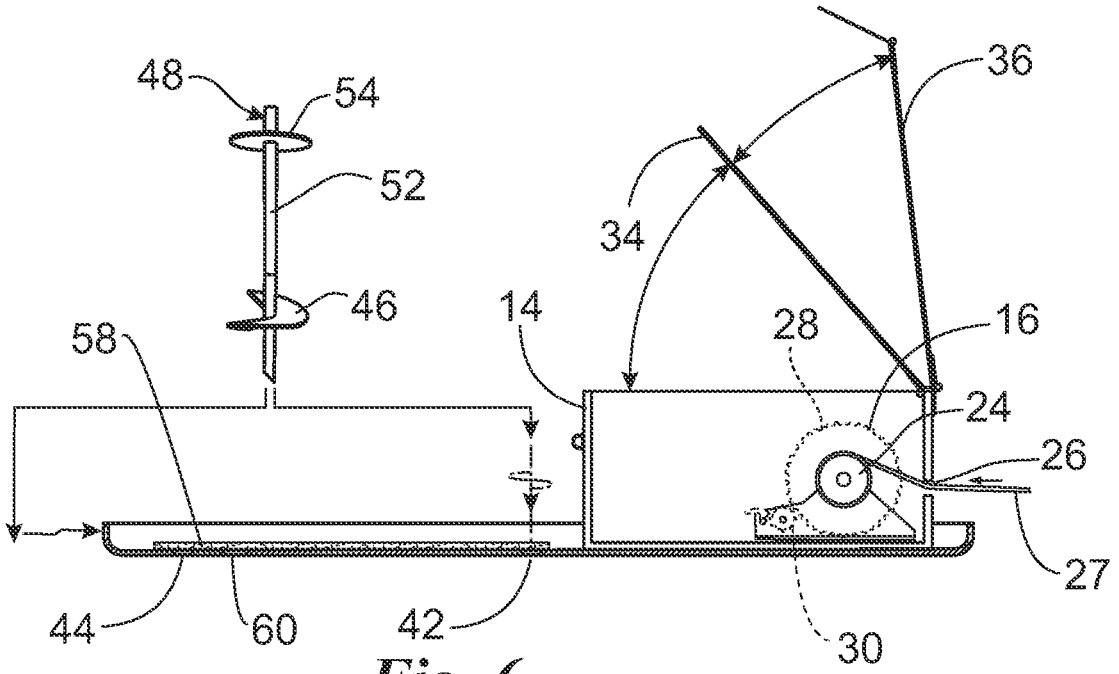
FIG. 6 shows a cross-section view of the crawl space winch system according to the present invention.
Figure 7:
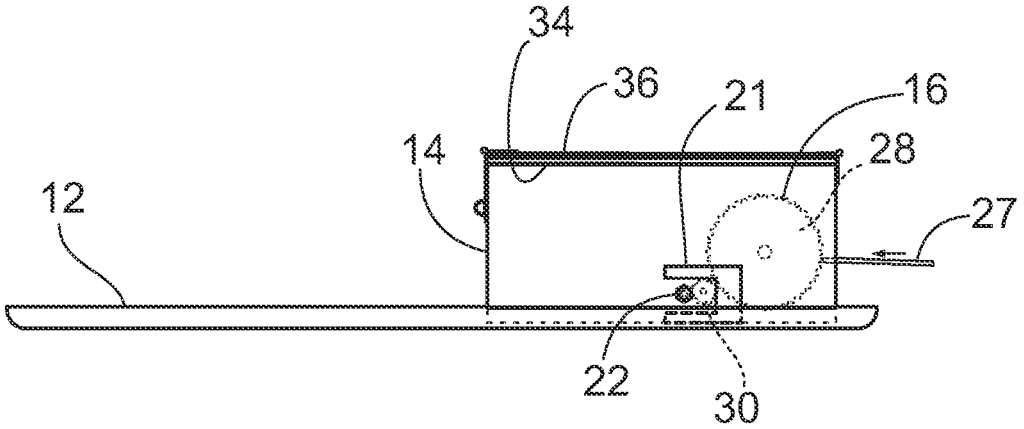
FIG. 7 shows a side view of the crawl space winch system according to the present invention.

Referring to FIGS. 5, 6, and 7, a lid 34 is preferably included on winch box 14 to enclose the winch box and help keep out debris. A separate shield 36 is pivotally mounted to the lid 34, which can be raised during winching to help protect the user. As best shown in FIGS. 6 and 7, shield 36 is operable between a deployed position extending upwardly from 34 lid, and a retracted position laying generally horizontally on top of lid 34. As safety is an issue in these confined spaces, when winching materials, the shield can be flip up to help protect the user who is kneeling on base plate 10.

The invention is used in very wet, dirty, and muddy environments so the winch box may need to be hosed off or otherwise cleaned for maintenance. To do this, each compartment of the winch box include drain holes 38 (best shown in FIG. 3) on at least one sidewall of the compartment, but preferably not in the bottom. If holes are in the bottom of winch box 14 and extend through base plate 10, they will pick up debris while transporting the unit to a work location.

The base plate 10 includes two large primary anchor openings for receiving primary anchors, which in the illustrated embodiment comprise screw anchors. Referring to FIGS. 1, 5, and 10 the first primary anchor opening 42 is disposed in a generally central portion of base plate 10. A second primary anchor opening 44 is disposed along a rear perimeter edge portion of base plate 10. In the illustrated embodiment, first and second primary anchor openings 42 and 44 each define a different shaped keyway for receiving a portion of a primary anchor 48 for securing base plate 10 to the ground. In the illustrated embodiment, primary anchors 48 are screw anchors and preferably auger-style screw anchors as shown in the illustrated embodiments. However, other types of screw and spiral ground anchors may also be used. Depending on the load, a single primary anchor 48 may be inserted through just one of primary anchor openings 42 and 44. This allows base plate 10 to rotate around the single primary anchor to accommodate changes in direction when winching items or setting up the position of base plate 10. Once positioned, the second primary anchor can be added as necessary to secure base plate 10 to the ground to resist pivoting of the base plate if desired. Additional secondary anchors described herein below may further be utilized in combination with the primary anchors 48 to secure the base plate 10 in position on the ground as desired.

Referring to FIGS. 1 and 10, preferably, the primary and secondary anchor opening 42, 44 are aligned in a linear arrangement with winch mechanism 16 in winch box 14, as shown by dotted line 41. This arrangement avoids unwanted pivoting and torque on base plate 10 when winching items in a straight line.

Figure 8:
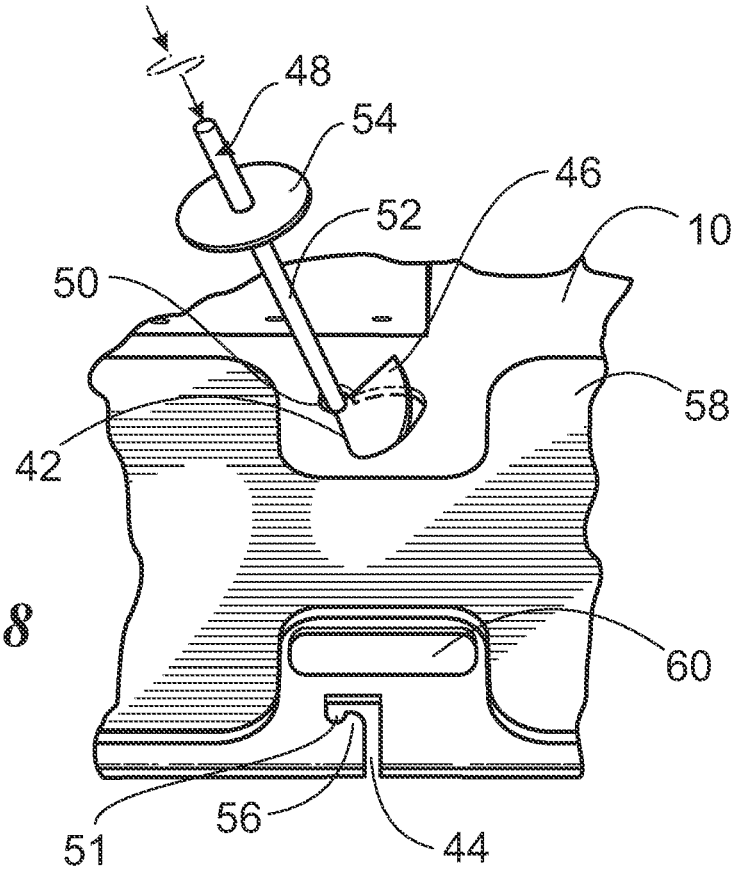
FIG. 8 shows a top perspective view of a primary anchor received in a primary anchor opening according to the present invention.
Figure 9:
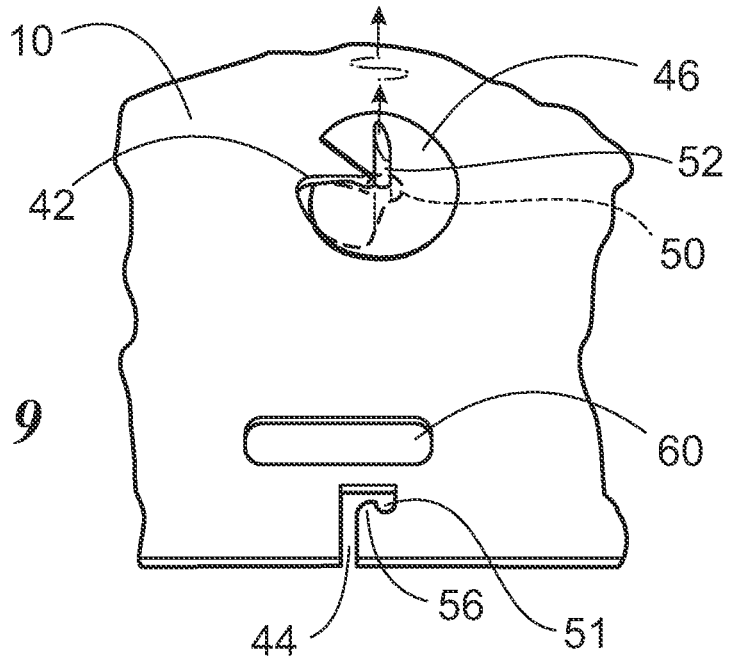
FIG. 9 shows a bottom perspective view of a primary anchor received in a primary anchor opening according to the present invention; and, FIG. 10 shows a top perspective view of an alternative embodiment of the base plate of the crawl space winch system according to the present invention.

Referring to FIGS. 5, 8, and 9, first primary anchor opening 42 has a complementary shape to receive a portion of blade 46 from the screw anchor 48. A notch 50 is defined in first primary anchor opening 42 that receives shaft 52 of screw anchor 48 as blade 46 is rotated and proceeds through first primary anchor opening 42. An end cap 54 on screw anchor 48 engages a top side of base plate 10 to apply pressure to base plate 10 to secure it to the ground as screw anchor 48 extends into the ground. In the illustrated embodiments, notch 50 of first primary anchor opening 42 is aligned in a linear arrangement with winch mechanism 16 as shown by dotted line 41.

Figure 4:
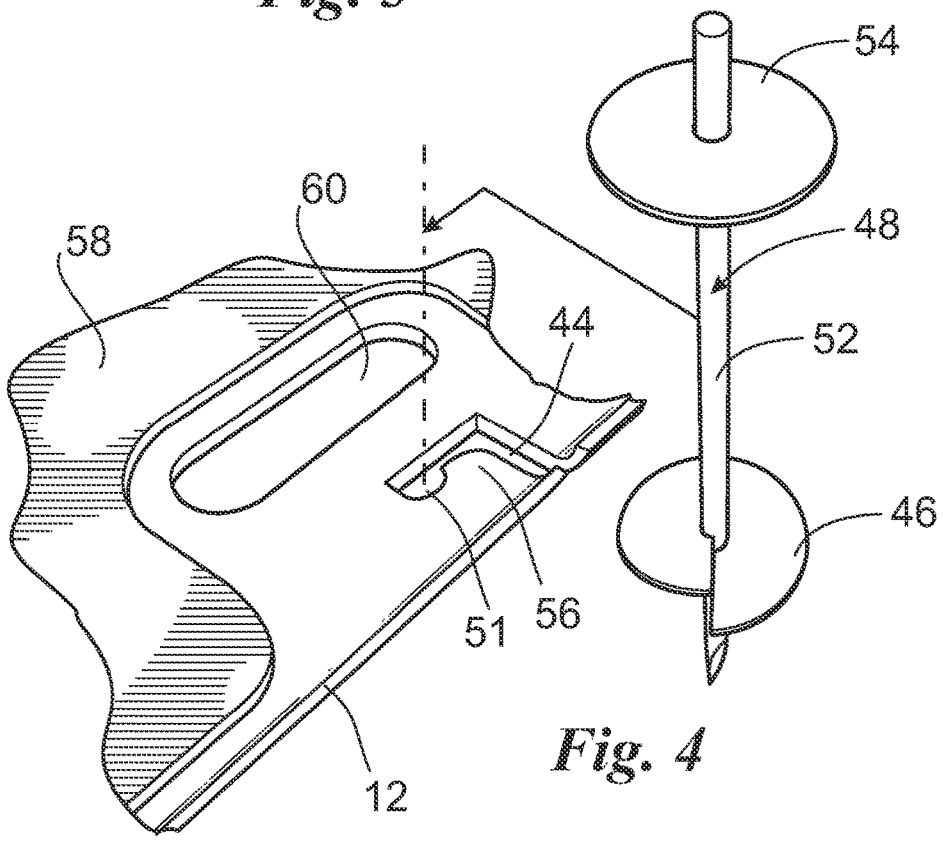
FIG. 4 shows a top perspective view of a primary anchor opening and primary anchor according to the present invention.

Referring to FIGS. 4 and 5, in the illustrated embodiment, second primary anchor opening 44 has a generally G-shaped channel in the rear perimeter edge of base plate 10. As screw anchor 48 is extended into the ground, base plate 10 is positioned to receive the shaft 52 of screw anchor 48. Tab portion 56 of the G-shaped channel helps to hold shaft 52 in position in notch 51 and resist backing out from the G-shaped channel.

Figure 2:
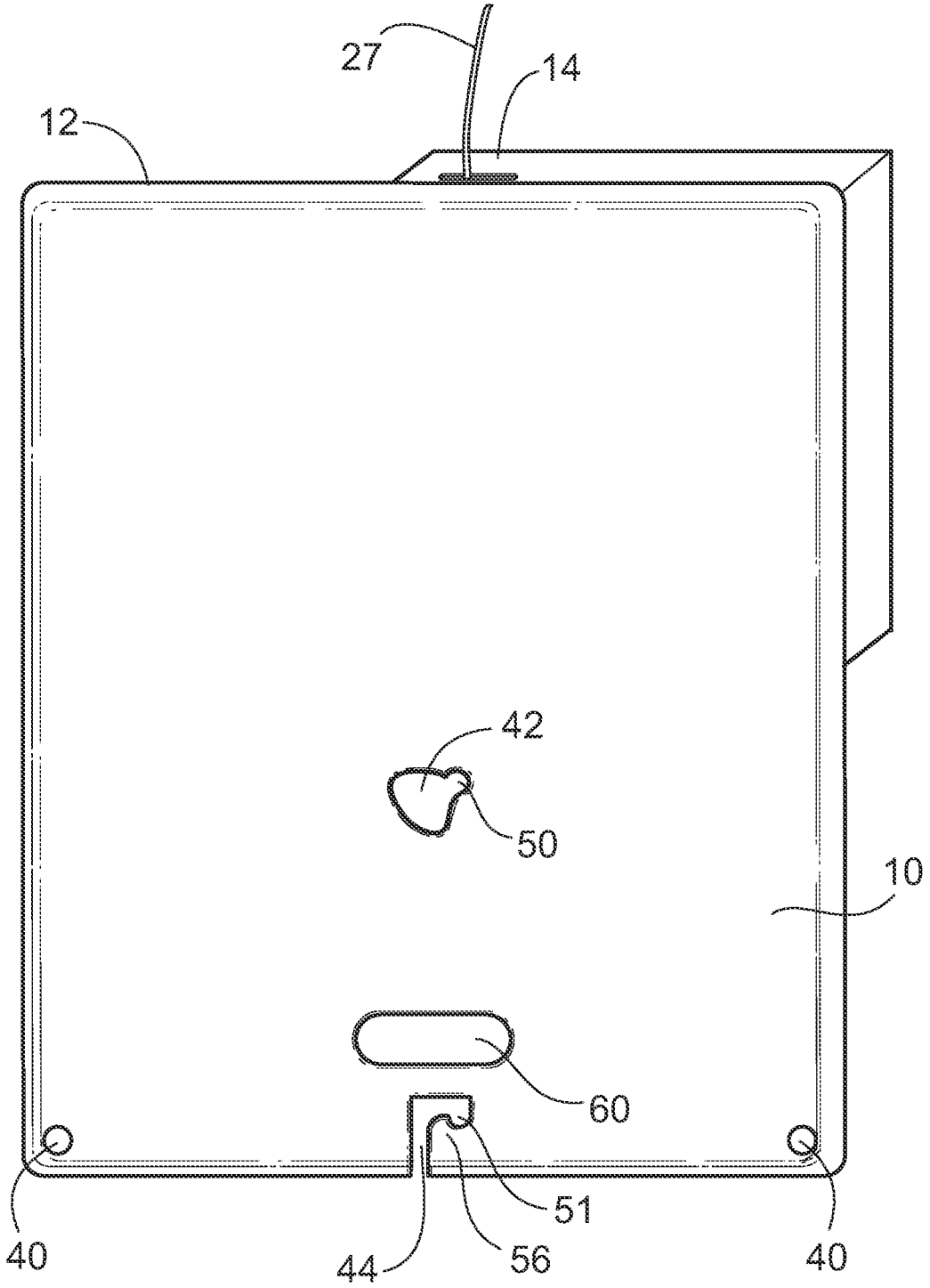
FIG. 2 shows a bottom perspective view of the crawl space winch system according to the present invention.
Figure 3:
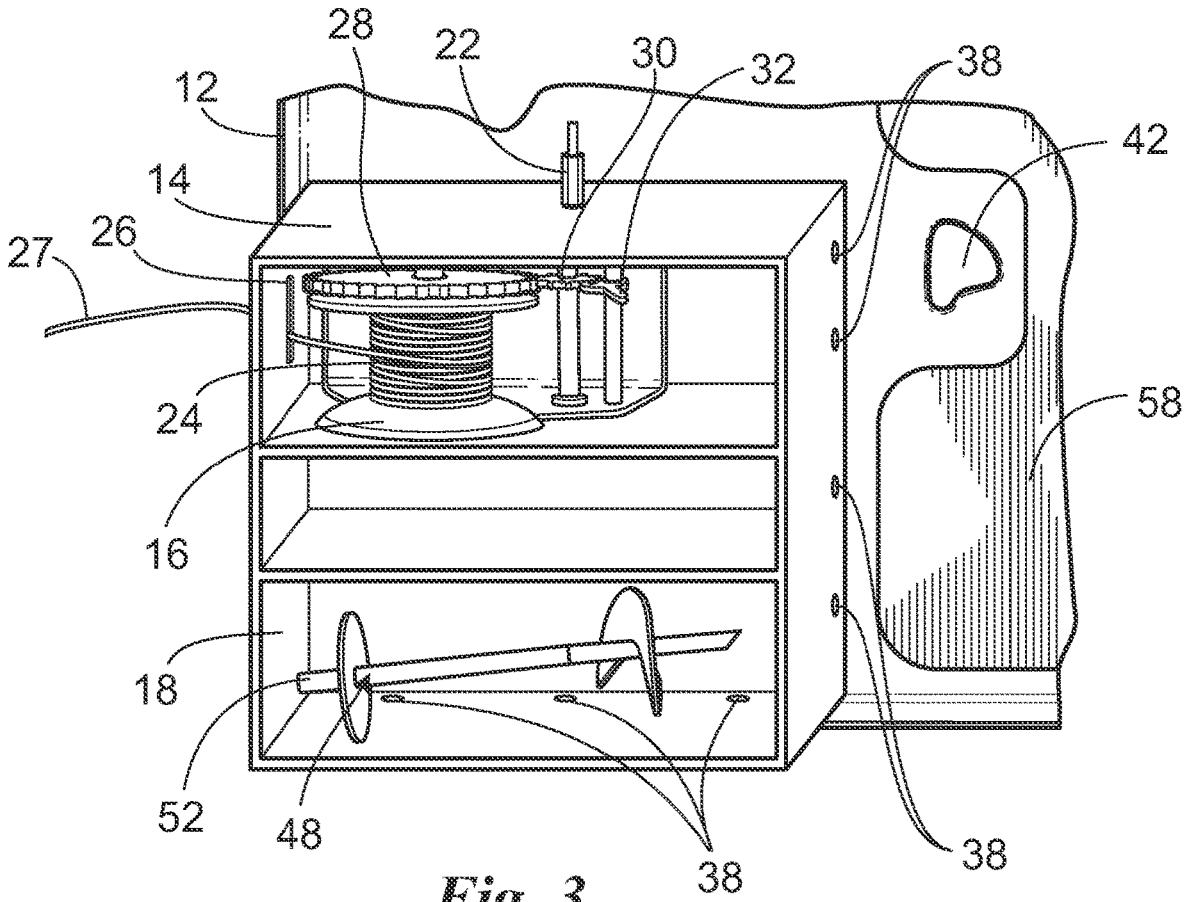
FIG. 3 shows a detailed top perspective view of the winch box with the lid removed according to the present invention.

Referring to FIGS. 1, 2 and 5, base plate 10 includes a series of secondary anchor openings 40. In the illustrated embodiment, the secondary anchor openings comprise circular anchor stake opening 40 that are located along a perimeter edge portion of base plate 10 for receiving a secondary anchor, which in one example embodiment, comprised an anchor stake 43 (FIG. 5) to secure the base plate 10 to the ground. These smaller opening are preferably located toward the rear corners of base plate 10 and are intended for smaller anchor bolts, such as a stake, that can range in length and thickness and can have threads, serrations or not. These secondary anchors can be used in combination with the primary anchors to secure the base plate, and can be used separately from the primary anchors when anchoring the base plate 10 to the ground when pulling lighter loads.

Referring to FIG. 5, in a preferred embodiment, a rubber or like knee pad 58 is disposed across portions of baes plate 10 for the user to rest on during use.

Referring to FIGS. 1, 5 and 10, in the illustrated embodiment, a handle opening 60 is dispose in base plate 10 to assist in carrying and moving the base plate 10.

In a preferred embodiment, the inside surface of winch box 14 is insulated with a rubber coating product to help insulate noise during operation of winch mechanism 16.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A crawl space winch system comprising:

a base plate;

a winch box carried by said base plate;

a winch mechanism disposed in said winch box and having a cable extending out of an opening in a front side of said winch box for attaching to an item;

a winch drive shaft extending through a sidewall of said winch box and being operatively associated with said winch mechanism for retracting said cable;

a primary anchor opening disposed in a generally central portion of said base plate for receiving a portion of a primary anchor to secure said base plate to the ground, and wherein said primary anchor provides a pivot point around which said base plate rotates;

a lid pivotally carried on a top side of said winch box for enclosing said winch box; and, a shield pivotally carried by said lid and operable between a deployed position extending upwardly from said lid, and a retracted position laying horizontally on top of said lid.

2. The crawl space winch of claim 1 wherein said base plate includes upturned edge portions extending along a perimeter on each side that facilitate sliding of the base plate on the ground and resist digging into the ground.

3. The crawl space winch of claim 1 wherein said winch drive shaft is adapted to engage a portable electric hand tool for rotating said winch drive shaft.

4. The crawl space winch of claim 3 including a support bracket mounted on said base plate adjacent said winch box and laterally spaced from said winch drive shaft for receiving said portable electric hand tool.

5. The crawl space winch of claim 1 wherein at least one storage slot is disposed in said winch box for carrying accessory items.

6. The crawl space winch of claim 1 including a knee pad disposed on a top side of said base plate.

7. The crawl space winch of claim 1 including at least one drain hole opening disposed in said winch box.

8. The crawl space winch of claim 1 including a handle opening disposed in said base plate to assist in carrying and moving said base plate.

9. The crawl space winch of claim 1 including a series of secondary anchor openings disposed adjacent a perimeter edge of said base plate for receiving a secondary anchor to secure said base plate to the ground.

10. The crawl space winch of claim 9 wherein said secondary anchor comprises a stake.

11. The crawl space winch of claim 1 including a second primary anchor opening disposed along a rear perimeter edge of said base plate.

12. The crawl space winch of claim 11 wherein said primary anchor openings each define a different shaped keyway for receiving a portion of a primary anchor.

13. The crawl space winch of claim 12 wherein said primary anchor comprises a screw anchor.

14. The crawl space winch of claim 1 wherein said primary anchor opening is aligned in a linear arrangement with said winch mechanism in said winch box.

15. The crawl space winch of claim 1 wherein said base plate includes a recessed portion along one side of said base plate in which a width of said base plate is narrowed such that a front perimeter edge is longer than a rear perimeter edge.

16. A crawl space winch system comprising:

a base plate having upturned edge portions that facilitate sliding on the ground;

a winch box carried by said base plate;

a winch mechanism disposed in said winch box and having a cable extending out of an opening in said winch box for winching an item;

a winch drive shaft extending through a sidewall of said winch box being operatively associated with said winch mechanism for retracting said cable; wherein said winch drive shaft is adapted to engage a portable electric hand tool for rotating said winch drive shaft;

at least one storage slot disposed in said winch box for carrying accessory items;

a lid pivotally carried on a top side of said winch box for enclosing said winch box;

a shield pivotally carried by said lid and operable between a deployed position extending upwardly from said lid, and a retracted position laying horizontally on top of said lid;

a primary anchor opening disposed in said base plate for receiving a portion of a primary anchor to secure said base plate to the ground, and wherein said primary anchor provides a pivot point around which said base plate rotates;

a knee pad disposed on a top side of said base plate;

at least one drain hole opening dispose in said winch box; and, a handle opening dispose in said base plate to assist in carrying and moving said base plate.

* * * * *